US007700191B2

(12) United States Patent
Zhu et al.

(10) Patent No.: US 7,700,191 B2
(45) **Date of Patent: *Apr. 20, 2010**

(54) FLAME RESISTANT SPUN STAPLE YARNS MADE FROM BLENDS OF FIBERS DERIVED FROM DIAMINO DIPHENYL SULFONE AND HIGH MODULUS FIBERS AND FABRICS AND GARMENTS MADE THEREFROM AND METHODS FOR MAKING SAME

(75) Inventors: Reiyao Zhu, Moseley, VA (US); Vlodek Gabara, Richmond, VA (US)

(73) Assignee: E.I. du Pont de Nemours and Company, Wiolmington, DE (US)

( * ) Notice: Subject to any disclaimer, the term of this patent is extended or adjusted under 35 U.S.C. 154(b) by 278 days.

This patent is subject to a terminal disclaimer.

(21) Appl. No.: 11/894,912

(22) Filed: Aug. 22, 2007

(65) Prior Publication Data

US 2009/0053954 A1 Feb. 26, 2009

(51) Int. Cl.
*D02G 3/00* (2006.01)
*B29D 28/00* (2006.01)

(52) U.S. Cl. ..... 428/364; 428/365; 428/920; 428/921; 442/136; 442/181; 442/302; 264/103

(58) Field of Classification Search ..... 428/364, 428/365, 920, 921; 442/136, 181, 302; 264/103
See application file for complete search history.

(56) References Cited

U.S. PATENT DOCUMENTS

| | | | | |
|---|---|---|---|---|
| 3,063,966 | A | 11/1962 | Kwolek et al. | |
| 3,227,793 | A | 1/1966 | Cipriani | |
| 3,287,324 | A | 11/1966 | Sweeny | |
| 3,414,645 | A | 12/1968 | Morgan, Jr. | |
| 3,621,646 | A | 11/1971 | Bobkowicz et al. | |
| 3,767,756 | A | 10/1973 | Blades | |
| 3,803,453 | A | 4/1974 | Hull | |
| 3,869,429 | A | 3/1975 | Blades | |
| 3,869,430 | A | 3/1975 | Blades | |
| 4,533,693 | A | 8/1985 | Wolfe et al. | |
| 4,612,150 | A | 9/1986 | De Howitt | |
| 4,703,103 | A | 10/1987 | Wolfe et al. | |
| 4,772,678 | A | 9/1988 | Sybert et al. | |
| 4,847,350 | A | 7/1989 | Harris | |
| 5,089,591 | A | 2/1992 | Gregory et al. | |
| 5,276,128 | A | 1/1994 | Rosenberg et al. | |
| 5,468,537 | A | 11/1995 | Brown et al. | |
| 5,667,743 | A | 9/1997 | Tai et al. | |
| 5,674,969 | A | 10/1997 | Sikkema et al. | |
| 2008/0057807 | A1 * | 3/2008 | Tutterow et al. | 442/1 |

FOREIGN PATENT DOCUMENTS

| | | |
|---|---|---|
| CN | 1389604 | 1/2003 |
| CN | 1389604 A | 1/2003 |
| CN | 1631941 A | 6/2005 |
| GB | 875068 | 8/1961 |
| WO | WO 00/77283 | 12/2000 |
| WO | WO 2007/014291 | 2/2007 |

* cited by examiner

*Primary Examiner*—Norca L Torres-Velazquez

(57) ABSTRACT

This invention relates to a flame-resistant spun staple yarns and fabrics and garments comprising these yarns and methods of making the same. The yarns have 50 to 95 parts by weight of a polymeric staple fiber containing a structure derived from a monomer selected from the group consisting of 4,4'diaminodiphenyl sulfone, 3,3'diaminodiphenyl sulfone, and mixtures thereof; and 5 to 50 parts by weight of a high modulus staple fiber having a tensile modulus of 200 grams per denier (180 grams per dtex) or greater or greater, based on 100 parts by weight of the polymeric fiber and the high modulus fiber in the yarn.

20 Claims, No Drawings

FLAME RESISTANT SPUN STAPLE YARNS MADE FROM BLENDS OF FIBERS DERIVED FROM DIAMINO DIPHENYL SULFONE AND HIGH MODULUS FIBERS AND FABRICS AND GARMENTS MADE THEREFROM AND METHODS FOR MAKING SAME

FIELD OF THE INVENTION

The invention relates to a flame-resistant spun staple yarns, and fabrics and garments comprising these yarns, and methods of making the same. The yarns have 50 to 95 parts by weight of a polymeric staple fiber containing a structure derived from a monomer selected from the group consisting of 4,4'diaminodiphenyl sulfone, 3,3'diaminodiphenyl sulfone, and mixtures thereof; and 5 to 50 parts by weight of a high modulus staple fiber having a tensile modulus of 200 grams per denier (180 grams per dtex) or greater or greater, based 100 parts by weight of the polymeric fiber and the high modulus fiber in the yarn.

BACKGROUND OF THE INVENTION

Firefighters, emergency response personnel, members of the military, racing personnel, and industrial workers that can be exposed to flames, high temperatures, and/or electrical arcs and the like, need protective clothing and articles made from thermally resistant fabrics. Any increase in the effectiveness of these protective articles, or any increase in the comfort or durability of these articles while maintaining protection performance, is welcomed.

A fiber known as polysulfonamide fiber (PSA) is made from a poly (sulfone-amide) polymer and has good thermal resistance due to its aromatic content and also has low modulus, which imparts more flexibility to fabrics made from the fiber; however, the fiber has low tensile break strength. This low tensile strength in fibers has a major impact on the mechanical properties of fabrics made from these fibers, with the most obvious result being a decrease in the durability of the fabrics and articles made from the fabrics. This low durability limits the ability to utilize this comfortable fiber in protective apparel, especially in firefighters' turnout coats that must function in extreme environments. Therefore what is needed is a way of incorporating PSA into yarns for use in protective apparel that utilizes the benefits of the PSA fiber while compensating for the limitations of the fiber.

SUMMARY OF THE INVENTION

In some embodiments, this invention relates to a flame-resistant spun yarn, woven fabric, and protective garment, comprising 50 to 95 parts by weight of a polymeric staple fiber containing a polymer or copolymer derived from a monomer selected from the group consisting of 4,4'diaminodiphenyl sulfone, 3,3'diaminodiphenyl sulfone, and mixtures thereof; and 5 to 50 parts by weight of a high modulus staple fiber having a tensile modulus of 200 grams per denier (180 grams per dtex) or greater, based on 100 parts by weight of the polymeric fiber and the high modulus fiber in the yarn. This invention also relates to a flame-resistant garment comprising in order, an inner thermal lining, a liquid barrier, and an outer shell fabric made from a woven fabric containing the flame-resistant yarn.

In some other embodiments, this invention relates to a method of producing a flame-resistant spun yarn comprising the steps of forming a fiber mixture of 50 to 95 parts by weight of a polymeric staple fiber containing a polymer or copolymer derived from a monomer selected from the group consisting of 4,4'diaminodiphenyl sulfone, 3,3'diaminodiphenyl sulfone, and mixtures thereof; and 5 to 50 parts by weight of a high modulus staple fiber having a tensile modulus of 200 grams per denier (180 grams per dtex) or greater or greater, based on the total amount of the polymeric fiber and the high modulus fiber in the yarn; and spinning the fiber mixture into a spun staple yarn.

DETAILED DESCRIPTION

The invention concerns a flame-resistant spun staple yarn made from a polymeric staple fiber derived diamino diphenyl sulfone monomer and a high modulus staple fiber having a tensile modulus of 200 grams per denier (180 grams per dtex) or greater or greater. By "flame resistant" it is meant the spun staple yarn, or fabrics made from the yarn, will not support a flame in air. In preferred embodiments the fabrics have a limiting oxygen index (LOI) of 26 and higher.

For purposes herein, the term "fiber" is defined as a relatively flexible, macroscopically homogeneous body having a high ratio of length to the width of the cross-sectional area perpendicular to that length. The fiber cross section can be any shape, but is typically round. Herein, the term "filament" or "continuous filament" is used interchangeably with the term "fiber."

As used herein, the term "staple fibers" refers to fibers that are cut to a desired length or are stretch broken, or fibers that occur naturally with or are made having a low ratio of length to the width of the cross-sectional area perpendicular to that length when compared with filaments. Man made staple fibers are cut or made to a length suitable for processing on cotton, woolen, or worsted yarn spinning equipment. The staple fibers can have (a) substantially uniform length, (b) variable or random length, or (c) subsets of the staple fibers have substantially uniform length and the staple fibers in the other subsets have different lengths, with the staple fibers in the subsets mixed together forming a substantially uniform distribution.

In some embodiments, suitable staple fibers have a length of 0.25 centimeters (0.1 inches) to 30 centimeters (12 inches). In some embodiments, the length of a staple fiber is from 1 cm (0.39 in) to 20 cm (8 in). In some preferred embodiments the staple fibers made by short staple processes have a staple fiber length of 1 cm (0.39 in) to 6 cm (2.4 in).

The staple fibers can be made by any process. For example, the staple fibers can be cut from continuous straight fibers using a rotary cutter or a guillotine cutter resulting in straight (i.e., non crimped) staple fiber, or additionally cut from crimped continuous fibers having a saw tooth shaped crimp along the length of the staple fiber, with a crimp (or repeating bend) frequency of preferably no more than 8 crimps per centimeter.

The staple fibers can also be formed by stretch breaking continuous fibers resulting in staple fibers with deformed sections that act as crimps. Stretch broken staple fibers can be made by breaking a tow or a bundle of continuous filaments during a stretch break operation having one or more break zones that are a prescribed distance creating a random variable mass of fibers having an average cut length controlled by break zone adjustment.

Spun staple yarn can be made from staple fibers using traditional long and short staple ring spinning processes that are well known in the art. For short staple, cotton system spinning fiber lengths from 1.9 to 5.7 cm (0.75 in to 2.25 in) are typically used. For long staple, worsted or woolen system spinning, fibers up to 16.5 cm (6.5 in) are typically used.

However, this is not intended to be limiting to ring spinning because the yarns may also be spun using air jet spinning, open end spinning, and many other types of spinning which converts staple fiber into useable yarns.

Spun staple yarns can also be made directly by stretch breaking using stretch-broken tow to top staple processes. The staple fibers in the yarns formed by traditional stretch break processes typically have length of up to 18 cm (7 in) long. However spun staple yarns made by stretch breaking can also have staple fibers having maximum lengths of up to around 50 cm (20 in.) through processes as described for example in PCT Patent Application No. WO 0077283. Stretch broken staple fibers normally do not require crimp because the stretch-breaking process imparts a degree of crimp into the fiber.

The term continuous filament refers to a flexible fiber having relatively small-diameter and whose length is longer than those indicated for staple fibers. Continuous filament fibers and multifilament yarns of continuous filaments can be made by processes well known to those skilled in the art.

By polymeric fibers containing a polymer or copolymer derived from an amine monomer selected from the group consisting of 4,4'diaminodiphenyl sulfone, 3,3'diaminodiphenyl sulfone, and mixtures thereof, it is meant the polymer fibers were made from a monomer generally having the structure:

$$NH_2—Ar_1—SO_2—Ar_2—NH_2$$

wherein $Ar_1$ and $Ar_2$ are any unsubstituted or substituted six-membered aromatic group of carbon atoms and $Ar_1$ and $Ar_2$ can be the same or different. In some preferred embodiments $Ar_1$ and $Ar_2$ are the same. Still more preferably, the six-membered aromatic group of carbon atoms has meta- or para-oriented linkages versus the $SO_2$ group. This monomer or multiple monomers having this general structure are reacted with an acid monomer in a compatible solvent to create a polymer. Useful acids monomers generally have the structure of $$Cl—CO—Ar_3—CO—Cl$$

wherein $Ar_3$ is any unsubstituted or substituted aromatic ring structure and can be the same or different from $Ar_1$ and/or $Ar_2$. In some preferred embodiments $Ar_3$ is a six-membered aromatic group of carbon atoms. Still more preferably, the six-membered aromatic group of carbon atoms has meta- or para-oriented linkages.

In some preferred embodiments $Ar_1$ and $Ar_2$ are the same and $Ar_3$ is different from both $Ar_1$ and $Ar_2$. For example, $Ar_1$ and $Ar_2$ can be both benzene rings having meta-oriented linkages while $Ar_3$ can be a benzene ring having para-oriented linkages. Examples of useful monomers include terephthaloyl chloride, isophthaloyl chloride, and the like. In some preferred embodiments, the acid is terephthaloyl chloride or its mixture with isophthaloyl chloride and the amine monomer is 4,4'diaminodiphenyl sulfone. In some other preferred embodiments, the amine monomer is a mixture of 4,4'diaminodiphenyl sulfone and 3,3'diaminodiphenyl sulfone in a weight ratio of 3:1, which creates a fiber made from a copolymer having both sulfone monomers.

In still another preferred embodiment, the polymeric fibers contain a copolymer, the copolymer having both repeat units derived from sulfone amine monomer and an amine monomer derived from paraphenylene diamine and/or metaphenylene diamine. In some preferred embodiments the sulfone amide repeat units are present in a weight ratio of 3:1 to other amide repeat units. In some embodiments, at least 80 mole percent of the amine monomers is a sulfone amine monomer or a mixture of sulfone amine monomers. For convenience, herein the abbreviation "PSA" will be used to represent all of the entire classes of fibers made with polymer or copolymer derived from sulfone monomers as previously described.

In one embodiment, the polymer and copolymer derived from a sulfone monomer can preferably be made via polycondensation of one or more types of diamine monomer with one or more types of chloride monomers in a dialkyl amide solvent suchs as N-methylpyrrolidone, dimethyl acetamide, or mixtures thereof. In some embodiments of the polymerizations of this type an inorganic salt such as lithium chloride or calcium chloride is also present. If desired the polymer can be isolated by precipitation with non-solvent such as water, neutralized, washed, and dried. The polymer can also be made via interfacial polymerization which produces polymer powder directly that can then be dissolved in a solvent for fiber production.

The polymer or copolymer can be spun into fibers via solution spinning, using a solution of the polymer or copolymer in either the polymerization solvent or another solvent for the polymer or copolymer. Fiber spinning can be accomplished through a multi-hole spinneret by dry spinning, wet spinning, or dry-jet wet spinning (also known as air-gap spinning) to create a multi-filament yarn or tow as is known in the art. The fibers in the multi-filament yarn or tow after spinning can then be treated to neutralize, wash, dry, or heat treat the fibers as needed using conventional technique to make stable and useful fibers. Exemplary dry, wet, and dry-jet wet spinning processes are disclosed U.S. Pat. Nos. 3,063,966; 3,227,793; 3,287,324; 3,414,645; 3,869,430; 3,869,429; 3,767,756; and 5,667,743.

Specific methods of making PSA fibers or copolymers containing sulfone amine monomers are disclosed in Chinese Patent Publication 1389604A to Wang et al. This reference discloses a fiber known as polysulfonamide fiber (PSA) made by spinning a copolymer solution formed from a mixture of 50 to 95 weight percent 4,4'diaminodiphenyl sulfone and 5 to 50 weight percent 3,3'diaminodiphenyl sulfone copolymerized with equimolar amounts of terephthaloyl chloride in dimethylacetamide. Chinese Patent Publication 1631941A to Chen et al. also discloses a method of preparing a PSA copolymer spinning solution formed from a mixture of 4,4'diaminodiphenyl sulfone and 3,3'diaminodiphenyl sulfone in a mass ratio of from 10:90 to 90:10 copolymerized with equimolar amounts of terephthaloyl chloride in dimethylacetamide. Still another method of producing copolymers is disclosed in U.S. Pat. No. 4,169,932 to Sokolov et al. This reference discloses preparation of poly(paraphenylene) terephthalamide (PPD-T) copolymers using tertiary amines to increase the rate of polycondensation. This patent also discloses the PPD-T copolymer can be made by replacing 5 to 50 mole percent of the paraphenylene diamine (PPD) by another aromatic diamine such as 4,4'diaminodiphenyl sulfone.

The spun staple yarns also include a high modulus staple fiber having a limiting oxygen index (LOI) of 21 or greater, meaning the high modulus staple fiber or fabrics made solely from the high modulus staple fiber will not support a flame in air. In some preferred embodiments the high modulus staple fiber has a LOI of at least 26 or greater.

In some preferred embodiments the high modulus staple fiber has a break tenacity greater than the break tenacity of the PSA staple fiber, which is generally 3 grams per denier (2.7 grams per dtex). In some embodiments, the high modulus staple fiber has a break tenacity of at least 5 grams per denier (4.5 grams per dtex) or greater. In some other embodiments the high modulus staple fiber has a break tenacity of at least 10 grams per denier (9 grams per dtex) or greater. The addition of the higher tenacity high modulus staple fiber provides the spun yarn with additional strength that translates into improved strength and durability in the final fabrics and garments made from the spun yarns. Also, in some cases, depending on the blending percentage, it is believed the additional tenacity provided by the high modulus staple fiber to the spun yarn is magnified in the fabrics and garments made from the yarn, resulting in more tenacity improvement in the fabric than in the spun yarn.

Many different fibers can be used as the high modulus staple fiber, including para-aramid fibers, polyazole fibers, carbon fibers, and mixtures thereof. In some embodiments para-aramid fiber can be used in the blend as the high modulus staple fiber. By aramid is meant a polyarnide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. In some embodiments, the preferred para-aramid is poly(paraphenylene terephthalamide). Methods for making para-aramid fibers useful are generally disclosed in, for example, U.S. Pat. Nos. 3,869,430; 3,869,429; and 3,767,756. Various forms of such aromatic polyarnide organic fibers are sold under the trademarks of Kevlar® and Twaron® by respectively, E.I. du Pont de Nemours and Company, of Wilmington, Del.; and Teijin, Ltd, of Japan. Also, fibers based on copoly(p-phenylene/3,4'-diphenyl ether terephthalamide) are defined as para-aramid fibers as used herein. One commercially available version of these fibers is known as Technora® fiber also available from Teijin, Ltd.

In some embodiments polyazole fibers can be used as the high modulus fiber in the blend. For example, suitable polyazoles include polybenzazoles, polypyridazoles, and the like, and can be homopolymers or copolymers. Additives can be used with the polyazoles and up to as much as 10 percent, by weight, of other polymeric material can be blended with the polyazoles. Also copolymers can be used having as much as 10 percent or more of other monomer substituted for a monomer of the polyazoles. Suitable polyazole homopolymers and copolymers can be made by known procedures, such as those described in U.S. Pat. Nos. 4,533,693 (to Wolfe, et al., on Aug. 6, 1985), 4,703,103 (to Wolfe, et al., on Oct. 27, 1987), 5,089,591 (to Gregory, et al., on Feb. 18, 1992), 4,772,678 (Sybert, et al., on Sep. 20, 1988), 4,847,350 (to Harris, et al., on Aug. 11, 1992), and 5,276,128 (to Rosenberg, et al., on Jan. 4, 1994).

In some embodiments the preferred polybenzazoles are polybenzimidazoles, polybenzothiazoles, and polybenzoxazoles. If the polybenzazole is a polybenzimidazole, preferably it is poly[5,5'-bi-1H-benzimidazole]-2,2'-diyl-1,3-phenylene which is called PBI. If the polybenzazole is a polybenzothiazole, preferably it is a polybenzobisthiazole and more preferably it is poly(benzo[1,2-d:4,5-d']bisthiazole-2,6-diyl-1,4-phenylene which is called PBT. If the polybenzazole is a polybenzoxazole, preferably it is a polybenzobisoxazole and more preferably it is poly(benzo[1,2-d:4,5-d'] bisoxazole-2,6-diyl-1,4-phenylene which is called PBO. In some embodiments the preferred polypyridazoles are rigid rod polypyridobisazoles including poly(pyridobisimidazole), poly(pyridobisthiazole), and poly(pyridobisozazole). The preferred poly(pyridobisozazole) is poly(1,4-(2,5-dihydroxy)phenylene-2,6-pyrido[2,3-d:5,6-d']bisimidazole which is called PIPD. Suitable polypyridobisazoles can be made by known procedures, such as those described in U.S. Pat. No. 5,674,969. High modulus carbon fibers are well known in the art and commercially available carbon fibers include Tenax® fibers available from Toho Tenax America, Inc.

In some embodiments, this invention relates to a flame-resistant spun yarn, woven fabric, and protective garment, comprising 50 to 95 parts by weight of a polymeric staple fiber containing a structure derived from a monomer selected from the group consisting of 4,4'diaminodiphenyl sulfone, 3,3'diaminodiphenyl sulfone, and mixtures thereof; and 5 to 50 parts by weight of a high modulus staple fiber having a tensile modulus of 200 grams per denier (180 grams per dtex) or greater and a tenacity of 10 grams per denier (9 grams per dtex) or greater, based on the total amount of the polymeric fiber and the high modulus fiber in the yarn. In some preferred embodiments the polymeric staple fiber is present in an amount of 50 to 75 parts by weight, and the high modulus staple fiber is present in an amount of 25 to 50 parts by weight, based on the total amount (100 total parts) of the polymeric staple fiber and the high modulus staple fiber in the yarn. In some other preferred embodiments the polymeric staple fiber is present in an amount of 60 to 70 parts by weight, and the high modulus staple fiber is present in an amount of 30 to 40 parts by weight, based on the total amount of the polymeric staple fiber and the high modulus staple fiber in the yarn.

In some preferred embodiments the various types of staple fibers are present as a staple fiber blend. By fiber blend it is meant the combination of two or more staple fiber types in any manner. Preferably the staple fiber blend is an "intimate blend", meaning the various staple fibers in the blend form a relatively uniform mixture of the fibers. In some embodiments the two or more staple fiber types are blended prior to or while the yarn is being spun so that the various staple fibers are distributed homogeneously in the staple yarn bundle.

If desired, the staple fiber blend can have, in addition, 1 to 5 parts by weight of an antistatic fiber that reduces the propensity for static buildup in the staple yarns, fabric, and garments. In some preferred embodiments the fiber for imparting this antistatic property is a sheath-core staple fiber having a nylon sheath and a carbon core. Suitable materials for supplying antistatic properties are described in U.S. Pat. Nos. 3,803,453 and 4,612,150.

The polymeric or PSA staple fiber while being fire retardant is a very weak fiber, with fibers generally having break tenacity of 3 grams per denier (2.7 grams per dtex) and low tensile moduli of 30 to 60 grams per denier (27 to 55 grams per dtex). It is believed that the addition of a relatively higher strength and higher modulus staple fiber in amounts as little as 20 percent by weight can contribute to increased fabric strength. In some other embodiments, it is believed that the addition of relatively higher strength and higher modulus staple fiber in amounts of 25 percent up to and including 50 percent by weight can provide a preferred fabric for use in protective garments. In some especially preferred embodiments the polymeric or PSA staple fiber is combined with higher tensile strength and higher modulus flame retardant staple fibers such as para-aramid staple fibers. A fabric made from this combination of staple fibers has lower stiffness and therefore is more flexible than a fabric made totally from higher amounts of the higher modulus staple fiber and has more durability for extreme environments. Because PSA fibers have high flame retardancy, the combination of lower strength but highly flexible PSA fiber with the higher modulus staple fiber will ensure the resulting flame-retardant fabric gives a garment a flexible fabric shell for environments where fire retardancy, durability, and flexibility are desired.

Fabrics can be made from the spun staple yarns and can include, but is not limited to, woven or knitted fabrics. General fabric designs and constructions are well known to those skilled in the art. By "woven" fabric is meant a fabric usually formed on a loom by interlacing warp or lengthwise yarns and filling or crosswise yarns with each other to generate any fabric weave, such as plain weave, crowfoot weave, basket weave, satin weave, twill weave, and the like. Plain and twill weaves are believed to be the most common weaves used in the trade and are preferred in many embodiments.

By "knitted" fabric is meant a fabric usually formed by interlooping yarn loops by the use of needles. In many instances, to make a knitted fabric spun staple yarn is fed to a knitting machine which converts the yarn to fabric. If desired, multiple ends or yarns can be supplied to the knitting machine either plied of unplied; that is, a bundle of yarns or a bundle of plied yarns can be co-fed to the knitting machine and knitted into a fabric, or directly into a article of apparel such as a glove, using conventional techniques. In some embodiments it is desirable to add functionality to the knitted fabric by co-feeding one or more other staple or continuous filament yarns with one or more spun staple yarns having the intimate blend of fibers. The tightness of the knit can be adjusted to meet any specific need. A very effective combination of properties for protective apparel has been found in for example, single jersey knit and terry knit patterns.

In some particularly useful embodiments, the spun staple yarns can be used to make flame-resistant garments. In some embodiments the garments can have essentially one layer of the protective fabric made from the spun staple yarn. Garments of this type include jumpsuits and coveralls for fire fighters or for military personnel. Such suits are typically used over the firefighters' clothing and can be used to parachute into an area to fight a forest fire. Other garments can include pants, shirts, gloves, sleeves and the like that can be wom in situations such as chemical processing industries or industrial electrical/utility where an extreme thermal event might occur. In some preferred embodiments the fabrics have an arc resistance of at least 0.8 calories per square centimeter per ounce per square yard.

In other embodiments the spun staple yarn is used to make a multi-layer flame-resistant garment. One such garment has a general construction such as disclosed in U.S. Pat. No. 5,468,537. Such garments generally have three layers or three types of fabric constructions, each layer or fabric construction performing a distinct function. There is an outer shell fabric that provides flame protection and serves as a primary defense from flames for the fire fighter, and in most embodiments this is the layer that uses the spun staple yarn. Adjacent the outer shell is a moisture barrier that is typically a liquid barrier but can be selected such that it allows moisture vapor to past through the barrier. Laminates of Gore-Tex® PTFE membrane or Neoprene® membranes on a fibrous nonwoven or woven meta-aramid scrim fabric are moisture barriers typically used in such constructions. Adjacent the moisture barrier is a thermal liner, which generally includes a batt of heat resistant fiber attached to an internal face cloth. The moisture barrier keeps the thermal liner dry and thermal liner protects the wearer from heat stress from the fire or heat threat being addressed by the wearer.

In another embodiment, this invention relates to a method of producing a flame-resistant spun yarn comprising forming a fiber mixture of 50 to 95 parts by weight of a polymeric staple fiber containing a structure derived from a monomer selected from the group consisting of 4,4'diaminodiphenyl sulfone, 3,3'diaminodiphenyl sulfone, and mixtures thereof; and 5 to 50 parts by weight of a high modulus staple fiber having a tensile modulus of 200 grams per denier (180 grams per dtex) or greater or greater, based on the total amount (100 total parts) of the polymeric fiber and the high modulus fiber in the yarn; and spinning the fiber mixture into a spun staple yarn. In some preferred embodiments the polymeric staple fiber is present in an amount of 50 to 75 parts by weight, and the high modulus staple fiber is present in an amount of 25 to 50 parts by weight, based on the total amount of the polymeric staple fiber and the high modulus staple fiber in the yarn. In some other embodiments, the polymeric staple fiber is present in an amount of 60 to 70 parts by weight, and the high modulus staple fiber is present in an amount of 30 to 40 parts by weight, based on the total amount of the polymeric staple fiber and the high modulus staple fiber in the yarn.

In one embodiment the fiber mixture of the polymeric staple fiber and the high modulus staple fiber is formed by making an intimate blend of the fibers. If desired, other staple fibers can be combined in this relatively uniform mixture of staple fibers. The blending can be achieved by any number of ways known in the art, including processes that creel a number of bobbins of continuous filaments and concurrently cut the two or more types of filaments to form a blend of cut staple fibers; or processes that involve opening bales of different staple fibers and then opening and blending the various fibers in openers, blenders, and cards; or processes that form slivers of various staple fibers which are then further processed to form a mixture, such as in a card to form a sliver of a mixture of fibers. Other processes of making an intimate fiber blend are possible as long as the various types of different fibers are relatively uniformly distributed throughout the blend. If yarns are formed from the blend, the yarns have a relatively uniform mixture of the staple fibers also. Generally, in most preferred embodiments the individual staple fibers are opened or separated to a degree that is normal in fiber processing to make a useful fabric, such that fiber knots or slubs and other major defects due to poor opening of the staple fibers are not present in an amount that detract from the final fabric quality.

In a preferred process, the intimate staple fiber blend is made by first mixing together staple fibers obtained from opened bales, along with any other staple fibers, if desired for additional functionality. The fiber blend is then formed into a sliver using a carding machine. A carding machine is commonly used in the fiber industry to separate, align, and deliver fibers into a continuous strand of loosely assembled fibers without substantial twist, commonly known as carded sliver. The carded sliver is processed into drawn sliver, typically by, but not limited to, a two-step drawing process.

Spun staple yarns are then formed from the drawn sliver using techniques including conventional cotton system or short-staple spinning processes such as open-end spinning and ring-spinning; or higher speed air spinning techniques such as Murata air-jet spinning where air is used to twist the staple fibers into a yarn. The formation of spun yarns can also be achieved by use of conventional woolen system or long-staple processes such as worsted or semi-worsted ring-spinning or stretch-break spinning. Regardless of the processing system, ring-spinning is the generally preferred method for making the spun staple yarns.

Test Methods

Basis weight values were obtained according to FTMS 191A; 5041.

Abrasion Test. The abrasion performance of fabrics is determined in accordance with ASTM D-3884-01 "Standard Guide for Abrasion Resistance of Textile Fabrics (Rotary Platform, Double Head Method)".

Instrumented Thermal Manikin Test. Burn protection performance is determined using "Predicted Burn Injuries for a Person Wearing a Specific Garment or System in a Simulated Flash Fire of Specific Intensity" in accordance with ASTM F 1930 Method (1999) using an instrumented thermal mannequin with standard pattern coverall made with the test fabric.

Arc Resistance Test. The arc resistance of fabrics is determined in accordance with ASTM F-1959-99 "Standard Test Method for Determining the Arc Thermal Performance Value of Materials for Clothing". The Arc Thermal Performance Value (ATPV) of each fabric, which is a measure of the amount of energy that a person wearing that fabric could be exposed to that would be equivalent to a 2nd degree burn from such exposure 50% of the time.

Grab Test. The grab resistance of fabrics (the break tensile strength) is determined in accordance with ASTM D-5034-95 "Standard Test Method for Breaking Strength and Elongation of Fabrics (Grab Test)".

Tear Test. The tear resistance of fabrics is determined in accordance with ASTM D-5587-03 "Standard Test Method for Tearing of Fabrics by Trapezoid Procedure".

Thermal Protection Performance (TPP) Test. The thermal protection performance of fabrics is determined in accordance with NFPA 2112 "Standard on Flame Resistant Garments for Protection of Industrial Personnel Against Flash Fire". The thermal protective performance relates to a fabric's ability to provide continuous and reliable protection to a wearer's skin beneath a fabric when the fabric is exposed to a direct flame or radiant heat.

Vertical Flame Test. The char length of fabrics is determined in accordance with ASTM D-6413-99 "Standard Test Method for Flame Resistance of Textiles (Vertical Method)".

Limiting Oxygen Index (LOI) is the minimum concentration of oxygen, expressed as a volume percent, in a mixture of oxygen and nitrogen that will just support the flaming combustion of a material initially at room temperature under the conditions of ASTM G125/D2863.

EXAMPLES

The invention is illustrated by, but is not intended to be limited by the following examples. All parts and percentages are by weight unless otherwise indicated.

Example 1

This example illustrates flame-resistant spun yarns and fabrics of intimate blends of PSA fiber and para-aramid staple fiber. The PSA staple fiber is made from polymer made from 4,4'diaminodiphenyl sulfone and 3,3'diaminodiphenyl sulfone copolymerized with equimolar amounts of terephthaloyl chloride in dimethylacetamide and is known under the common designation of Tanlon®; the para-aramid staple fiber is made from poly(paraphenylene terephthalamide) polymer, has a modulus of 500 grams per denier (450 grams per dtex) and a tenacity of 23 grams per denier (21 grams per dtex), and is marketed by E.I. du Pont de Nemours & Company under the trademark Kevlar®29 fiber.

A picker blend sliver of 40 wt. % para-aramid fiber and 60% PSA fiber is prepared and processed by the conventional cotton system equipment and is then spun into a staple yarn having a twist multiplier 4.0 and a single yarn size of 21 tex (28 cotton count) using a ring spinning frame. Two such single yarns are then plied on a plying machine to make a two-ply flame resistant yarn for use as a fabric warp yarn. Using a similar process and the same twist and blend ratio, a 24 tex (24 cotton count) singles yarn is made and two of these single yarns are plied to form a two-ply fabric fill yarn.

The ring spun yarns of intimate blends of PSA fiber and poly(paraphenylene terephthalamide) staple fiber are then used as the warp and fill yarns and are woven into a fabric on a shuttle loom, making a greige fabric having a 2×1 twill weave and a construction of 26 ends×17 picks per cm (72 ends×52 picks per inch), and a basis weight of 215 g/m$^2$ (6.5 oz/yd$^2$). The greige twill fabric is then scoured in hot water and is dried under low tension. The scoured fabric is then jet dyed using basic dye. The resulting fabric has a basis weight of 231 g/m$^2$ (7 oz/yd$^2$) and an LOI in excess of 28. Table 1 illustrates properties of the resulting fabric. A "+" indicates superior properties to those of the control fabric, while the notation "0" indicates the performance of the control fabric or performance equivalent to the control fabric. A "0/+" means the performance is slightly better than the control fabric.

TABLE 1

| Property | 100% PSA | Example 1 |
|---|---|---|
| Nominal Basis Weight (opsy) | 7 | 7 |
| Grab Test Break Strength (lbf) W/F | 0 | + |
| Trap Tear (lbf) W/F | 0 | + |
| Taber Abrasion (Cycles)CS-10/1000 g | 0 | + |
| TPP (cal/cm$^2$) | 0 | 0/+ |
| Vertical Flame (in) W/F | 0 | + |
| Instrumented Thermal Manikin Test (% of body burn) | 0 | 0/+ |
| ARC rating(cal/cm$^2$) | 0 | 0/+ |

Example 2

The fabric of Example 1 is used as an outer shell fabric for a three-layer composite fabric that also includes a moisture barrier and a thermal liner. The moisture barrier is Goretex having a basis weight of 0.7 oz/yd$^2$ attached to a nonwoven poly(metaphenylene isophthalamide)/poly(paraphenylene terephthalamide) fiber blend substrate having a basis weight of 2.7 oz/yd$^2$. The thermal liner is made from three 1.5 oz/yd$^2$ spunlaced poly(metaphenylene isophthalamide)/poly(paraphenylene terephthalamide) fiber sheets quilted to a 3.2 oz/yd$^2$ poly(metaphenylene isophthalamide) staple fiber scrim. Protective garments such as fireman turnout coats are then made from the composite fabric.

Example 3

The fabric of Example 1 is made into protective articles, including garments, by cutting the fabric into fabric shapes per a pattern and sewing the shapes together to form a protective coverall for use as protective apparel in industry. Likewise, the fabric is cut into fabric shapes and the shapes sewn together to form a protective apparel combination comprising a protective shirt and a pair of protective pants. If desired, the fabric is cut and sewn to form other protective apparel components such as, coveralls, hoods, sleeves, and aprons.

What is claimed:

1. A flame-resistant spun yarn consisting of:

50 to 95 parts by weight of polymeric staple fiber containing a polymer or copolymer derived from a monomer selected from the group consisting of 4,4' diaminodiphenyl sulfone, 3,3' diaminodiphenyl sulfone, and mixtures thereof and 5 to 50 parts by weight of high modulus staple fiber having a tensile modulus of 200 grams per denier (180 grams per dtex) or greater; based on 100 parts by weight of the polymeric fiber and the high modulus staple fiber in the yarn.

2. The flame-resistant spun yarn of claim 1 wherein, the polymeric staple fiber is present in an amount of 50 to 75 parts by weight; and the high modulus staple fiber is present in an amount of 25 to 50 parts by weight, based on 100 parts by weight of the polymeric staple fiber and the high modulus staple fiber in the yarn.

3. The flame-resistant spun yarn of claim 2 wherein, the polymeric staple fiber is present in an amount of 60 to 70 parts by weight; and the high modulus staple fiber is present in an amount of 30 to 40 parts by weight, based on the total amount of the polymeric staple fiber and the high modulus staple fiber in the yarn.

4. The flame-resistant spun yarn of claim 1 wherein, at least 80 mole percent of the polymer or copolymer used in the polymeric staple fiber is derived from a sulfone amine monomer or a mixture of sulfone amine monomers.

5. The flame-resistant spun yarn of claim 1 wherein, the high modulus staple fiber has a tenacity of 5 grams per denier (4.5 grams per dtex) or greater.

6. The flame-resistant spun yarn of claim 1 wherein, the high modulus staple fiber has a tenacity of 10 grams per denier (9 grams per dtex) or greater.

7. The flame-resistant spun yarn of claim 1 wherein, the polymeric staple fiber contains a structure derived from the monomer selected from the group of terephthaloyl chloride, isophthaloyl chloride, and mixtures thereof.

8. The flame-resistant spun yarn of claim 1 wherein, the high modulus staple fiber comprises poly(paraphenylene terephthalamide).

9. The flame-resistant spun yarn of claim 1 wherein, the high modulus staple fiber is a fiber selected from the group of para-aramid, polyazoles, carbon, and mixtures thereof.

10. A woven fabric comprising the yarn of claim 1.

11. A protective garment comprising the yarn of claim 1.

12. A flame-resistant garment comprising, in order:

an inner thermal lining, a liquid baffler; and an outer shell fabric, the outer shell fabric comprising the woven fabric of claim 10.

13. A method of producing a flame-resistant spun yarn comprising:

a) forming a fiber mixture consisting of 50 to 95 parts by weight of a polymeric staple fiber containing a polymer or copolymer derived from a monomer selected from the group consisting of 4,4' diaminodiphenyl sulfone, 3,3' diaminodiphenyl sulfone, and mixtures thereof; and 5 to 50 parts by weight of high modulus staple fiber having a tensile modulus of 200 grams per denier (180 grams per dtex) or greater, based on 100 parts by weight of the polymeric fiber and the high modulus fiber in the yarn; and b) spinning the fiber mixture of step a into a spun staple yarn.

14. The method of producing a flame-resistant spun yarn of claim 13 wherein, the polymeric staple fiber is present in an amount of 50 to 75 parts by weight; and the high modulus staple fiber is present in an amount of 25 to 50 parts by weight, based on 100 parts by weight of the polymeric staple fiber and the high modulus staple fiber in the yarn.

15. The method of producing a flame-resistant spun yarn of claim 14 wherein, the polymeric staple fiber is present in an amount of 60 to 70 parts by weight; and the high modulus staple fiber is present in an amount of 30 to 40 parts by weight, based on 100 parts by weight of the polymeric staple fiber and the high modulus staple fiber in the yarn.

16. The method of producing a flame-resistant spun yarn of claim 13 wherein, at least 80 mole percent of the polymer or copolymer used in the polymeric staple fiber is derived from a sulfone amine monomer or a mixture of sulfone amine monomers.

17. The method of producing a flame-resistant spun yarn of claim 13 wherein, the high modulus staple fiber has a tenacity of 5 grams per denier (4.5 grams per dtex) or greater.

18. The method of producing a flame-resistant spun yarn of claim 13 wherein, the polymeric staple fiber contains a structure derived from the monomer selected from the group of terephthaloyl chloride, isophthaloyl chloride, and mixtures thereof.

19. The method of producing a flame-resistant spun yarn of claim 13 wherein, the high modulus staple fiber comprises poly(paraphenylene terephthalamide).

20. The method of producing a flame-resistant spun yarn of claim 13 wherein, the high modulus staple fiber is a fiber selected from the group of para-aramid, polyazoles, carbon, and mixtures thereof.

* * * * *